US006212919B1

(12) United States Patent
Gerow

(10) Patent No.: US 6,212,919 B1
(45) Date of Patent: Apr. 10, 2001

(54) ADJUSTABLE CABLE LOOP LOCKING SYSTEM FOR SECURING A PAIR OF SPACIALLY SEPARATED ARTICLES TOGETHER

(76) Inventor: John S. Gerow, 5441 Palmetto Ave., Ft. Pierce, FL (US) 34982

( * ) Notice: Subject to any disclaimer, the term of this patent is extended or adjusted under 35 U.S.C. 154(b) by 0 days.

(21) Appl. No.: 09/347,883

(22) Filed: Jul. 6, 1999

(51) Int. Cl.[7] ..... E05B 73/00
(52) U.S. Cl. ..... 70/18; 70/49; 24/132 R
(58) Field of Search ..... 70/14, 18, 19, 70/30, 49; 24/132 R

(56) References Cited

U.S. PATENT DOCUMENTS

| | | | | |
|---|---|---|---|---|
| 1,526,606 | * | 2/1925 | Moloney | 70/440 |
| 2,623,378 | | 12/1952 | Haver | 70/49 |
| 3,540,083 | * | 11/1970 | O'Connor | 24/132 R |
| 3,798,934 | * | 3/1974 | Wright et al. | 70/18 X |
| 3,808,847 | * | 5/1974 | Vesely | 70/18 |
| 3,841,118 | | 10/1974 | Stone | 70/33 |
| 3,987,653 | | 10/1976 | Lyon et al. | 70/19 |
| 4,057,983 | * | 11/1977 | Morgan | 70/18 |
| 4,077,697 | * | 3/1978 | Yates | 24/132 R |
| 4,118,960 | * | 10/1978 | Lipschutz | 70/19 X |
| 4,639,978 | * | 2/1987 | Boden | 24/132 R |
| 4,685,315 | * | 8/1987 | Comolli | 70/18 X |
| 4,719,773 | | 1/1988 | Alberts | 70/18 |
| 4,811,577 | | 3/1989 | Webster et al. | 70/14 |
| 4,878,270 | * | 11/1989 | Westerkamp | 24/132 R |
| 4,907,522 | | 3/1990 | Lutzke | 114/230 |
| 5,070,712 | | 12/1991 | Fox | 70/18 |
| 5,440,789 | * | 8/1995 | Lofland | 24/132 R |
| 5,481,888 | * | 1/1996 | Perry | 70/18 |
| 5,517,835 | | 5/1996 | Smith | 70/14 |
| 5,690,042 | * | 11/1997 | Bentley | 70/18 X |
| 5,727,351 | * | 3/1998 | Neathery et al. | 70/49 X |
| 5,752,416 | * | 5/1998 | Nien | 70/18 X |
| 5,791,170 | | 8/1998 | Officer | 70/49 |
| 5,823,020 | | 10/1998 | Benda | 70/18 |
| 5,896,762 | * | 4/1999 | Iidaka et al. | 70/18 X |
| 5,950,284 | * | 9/1999 | Persson | 24/132 R |
| 5,966,876 | * | 10/1999 | Neathery et al. | 70/49 X |
| 6,003,348 | * | 12/1999 | McCrea | 70/18 |
| 6,026,662 | * | 2/2000 | Schlipper | 70/18 |
| 6,047,930 | * | 4/2000 | Bello | 24/132 R |

FOREIGN PATENT DOCUMENTS

| | | | | |
|---|---|---|---|---|
| 726908 | * | 10/1942 | (DE) | 70/18 |
| 12126 | * | 6/1980 | (EP) | 24/132 R |
| 1603852 | * | 12/1981 | (GB) | 24/132 R |

* cited by examiner

*Primary Examiner*—Suzanne Dino Barrett
(74) *Attorney, Agent, or Firm*—Maurice L. Miller, Jr.

(57) ABSTRACT

An adjustable cable loop locking system for securing two spaced apart articles, such as a boat to dock piling, with a length of flexible cable is disclosed. The system includes first and second mechanisms slidably disposed on opposite end portions of a cable in which are formed first and second cable loops respectively. A flexible sheath, which may be a conventional hollow hydraulic hose, slidably covers a central portion of cable and is affixed on opposite ends thereof to the first and second mechanisms to fix the distance between the mechanism as measured along the central portion of the cable. The two lead-in portions of the first loop slidably extend through the first mechanism except that one of these lead-in portions which contains a free end of the cable can be selectively locked in a stationary position in the first mechanism by operation of a locking handle when desired. One of the lead-in portions of the second loop which extends from the first mechanism extends slidably through the second mechanism to the second loop, the end of the cable at the end of the second loop being fastened in the second mechanism. The arrangement permits securing two spaced apart articles together while needing to lock only the first of the two mechanisms.

12 Claims, 2 Drawing Sheets

ADJUSTABLE CABLE LOOP LOCKING SYSTEM FOR SECURING A PAIR OF SPACIALLY SEPARATED ARTICLES TOGETHER

BACKGROUND OF THE INVENTION

This invention relates to a system for securing two spaced apart articles together with a length of cable, the cable containing a pair of loop forming mechanisms on opposite end portions thereof wherein only one of the mechanisms requires locking in order to secure the articles to the cable.

Broadly speaking, looped cable locking devices have long been known in the prior art. See U.S. Pat. No. 2,623,378 granted to G. D. Hauer on Dec. 30, 1952; U.S. Pat. No. 3,841,118 granted to R. W. Stone on Oct. 15, 1974; U.S. Pat. No. 3,987,653 granted to R. Lyon et al. on Oct. 26, 1976; and U.S. Pat. No. 5,070,712 granted to D. Fox on Dec. 10, 1991, to mention but a few. The Fox patent discloses a cable locking device having an elongated handle which pivots into and out of an open edged handle housing and contains registrable apertures in a free end of the handle and through end portions of the side walls of the housing opposite the end in which the handle is pivotally attached to the housing. The shackle of a pad lock can be inserted through the apertures in the housing and handle when registered to lock the handle in the housing to secure a rope loop therein. However, all of the aforementioned patents disclose systems which require a locking device on both ends of a cable in order to trap or lock cable end loops to separate articles to be fastened together. It therefore would be desirable to provide a system for joining two separated articles together with a cable containing loop forming mechanisms on opposite end portions thereof wherein only one of the mechanisms needs to be locked.

By means of my invention, these and other difficulties encountered in the prior art are substantially eliminated.

SUMMARY OF THE INVENTION

It is an object of my invention to provide an adjustable cable loop locking system for securing two spaced apart articles together with a length of cable.

If is a further object of my invention to provide such a cable loop locking system containing a first mechanism on one end portion of a cable to form a first adjustable loop and a second mechanism on an opposite end portion of the cable to form a second adjustable loop.

It is another object of my invention to provide a pair of mechanisms slidably disposed on opposite end portions of a length of cable for forming loops on opposite end portions of the cable which require the locking of only one of the mechanisms to secure a pair of spaced apart articles together with the cable.

Briefly, in accordance with my invention, I provide a system for securing a pair of spacially separated articles together which includes an elongated, flexible cable and a first mechanism slidably containing two lead-in portions of a first loop formed on a first end portion of the cable for adjusting the size of the first loop. A second mechanism is provided which slidably contains a first of two lead-in portions of a second loop formed on a second end portion of the cable for permitting adjustment in the size of the second loop. An end of the cable at an end of the second loop is fixedly secured to the second mechanism. Next, a device is provided for selectively fixing a first of the two lead-in portions of the first loop in a stationary position within the first mechanism when in an operative condition. The first of the two lead-in portions of the first loop contains a free end of the cable. A second of the two lead-in portions of the first loop is connected to the first of the two lead-in portions of the second loop to form a central portion of the cable extending between the first and second mechanisms. An elongated, flexible, hollow sheath is provided which slidably covers the central portion of the cable. The sheath is affixed on opposite end portions thereof to the first and second mechanisms such that the first and second mechanisms are spaced apart by a fixed distance as measured along the central portion of the cable.

These and other objects, features and advantages of my invention will become apparent to those skilled in the art from the following detailed description and attached drawings upon which, by way of example, only a preferred embodiment of my invention is described and illustrated.

DESCRIPTION OF THE PREFERRED EMBODIMENT

Figure 1:
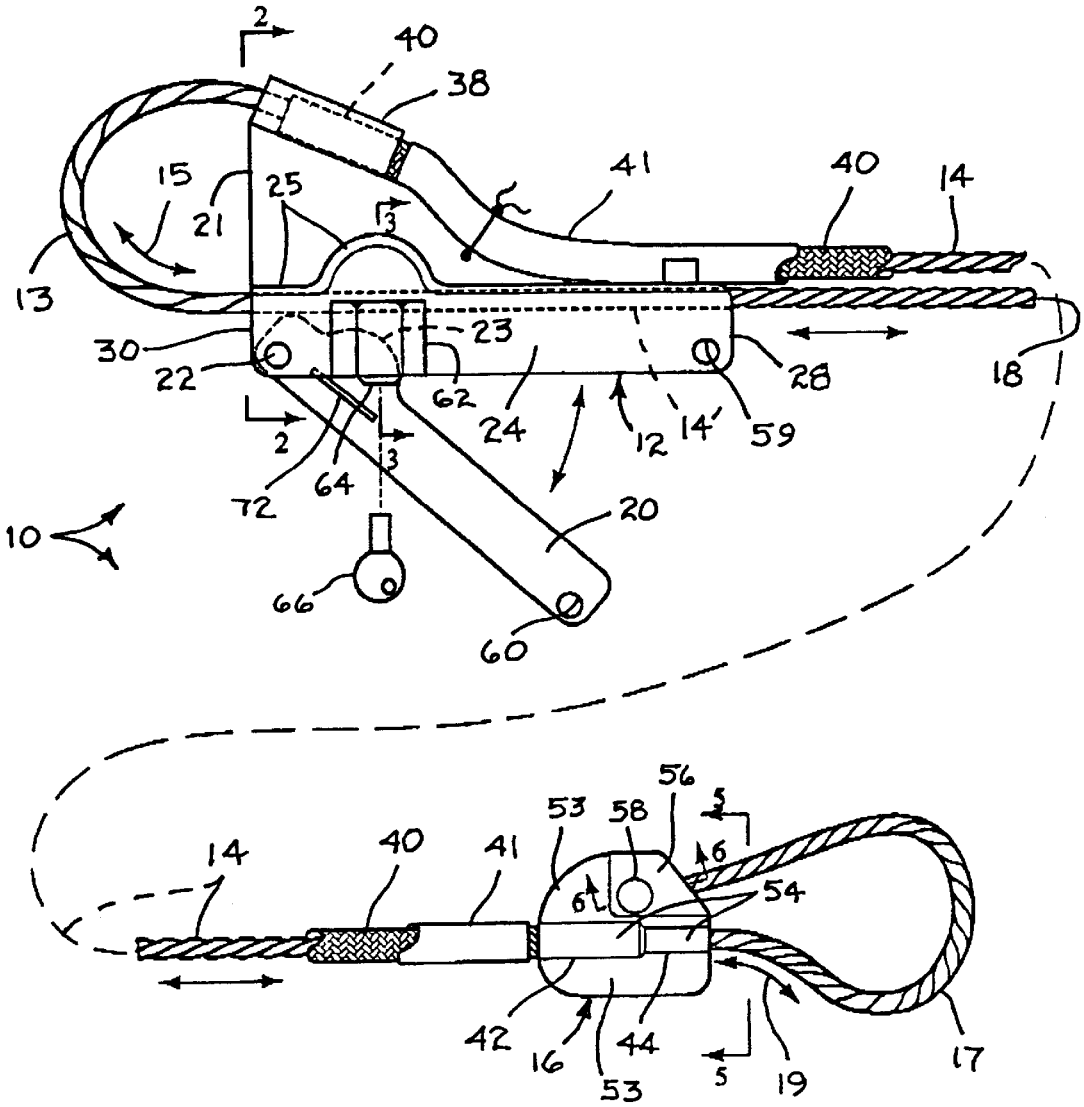
FIG. 1 shows a plan view of an adjustable cable loop locking system for securing a pair of spacially separated articles together, the system including a pivotal cable locking bar shown in an open, unlocked position, thus illustrating a preferred embodiment of my invention.

Referring now to the drawing figures there is shown, in a preferred embodiment of my invention, an adjustable cable loop locking system, generally designated 10, for securing a pair of spacially separated articles together. The system 10 is well adapted for mooring a boat, such as a house boat, motor boat or launch, cabin cruiser or jet ski to a mooring post, dock piling or docking cleat. The system 10 can also be used to secure a light air craft to an air craft tiedown and for numerous other purposes.

Figure 6:
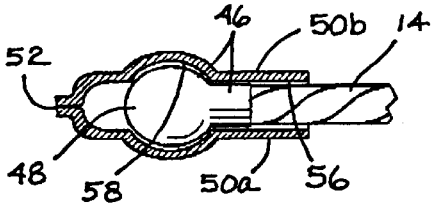
FIG. 6 shows a cross-sectional view of a fragment of the second mechanism of FIGS. 1 and 5 as viewed along cross-section lines 6—6 of FIG. 1.

The system 10 includes a first cable loop forming mechanism, generally designated 12, which, in an unlocked condition as later explained, slidably contains the two lead-in portions of a first loop 13 formed on a first end portion of an elongated, flexible cable 14. The first mechanism 12 contains a relatively flat central body portion 21 and permits manual adjustments in the size of the first loop 13 as represented by a double headed arrow 15 in FIG. 1. The cable 14 may be of any suitable length as needed and should have a strength rating which is sufficient for the particular use of the system 10. I prefer that the cable 14 be ¼ inch diameter stainless steel 7×19 braided cable as is available from the Indusco Group, 429 Talleyrand Avenue, Jacksonville, Fla. 32201-4758. The system 10 also includes a second cable loop forming mechanism 16 which slidably contains a first of the two lead-in portions of a second loop 17 formed on a second end portion of the cable 14 for permitting adjustment in the size of the second loop as indicated by a double headed arrow 19 in FIG. 1. An end of the cable 14 at the end of the second loop 17 is fixedly secured to the second mechanism 16 in any suitable manner but, preferably, as shown in FIG. 6 and as later explained herein. An opposite end 18 of the cable 14 on the end of a first lead-in portion of the first loop 13 is free and unattached.

Figure 2:
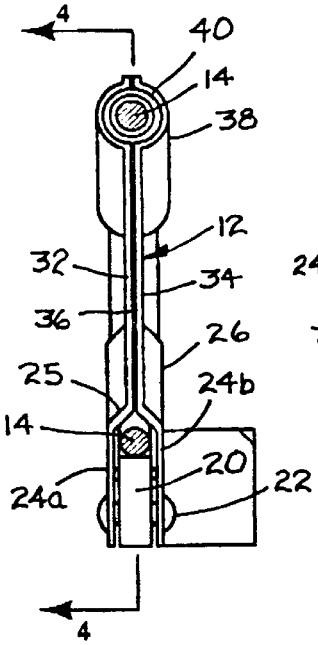
FIG. 2 shows a cross-sectional elevation view of a first mechanism of the system of FIG. 1 as viewed along cross-section lines 2—2 of the latter mentioned figure, the locking bar of FIG. 1 being shown here in a closed position.
Figure 3:
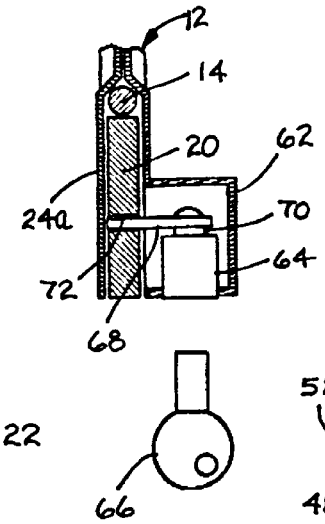
FIG. 3 shows a cross-sectional view of a portion of the first mechanism of FIGS. 1–2 as viewed along cross-section lines 3—3 of FIG. 1 except that, in this view, the locking bar of FIGS. 1–2 is shown in a closed and locked position.
Figure 5:
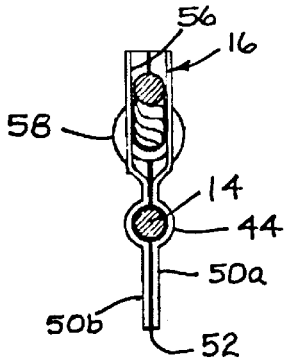
FIG. 5 shows a cross-sectional view of a second mechanism of FIG. 1 as viewed along cross-section lines 5—5 of the latter mentioned figure.
Figure 4:
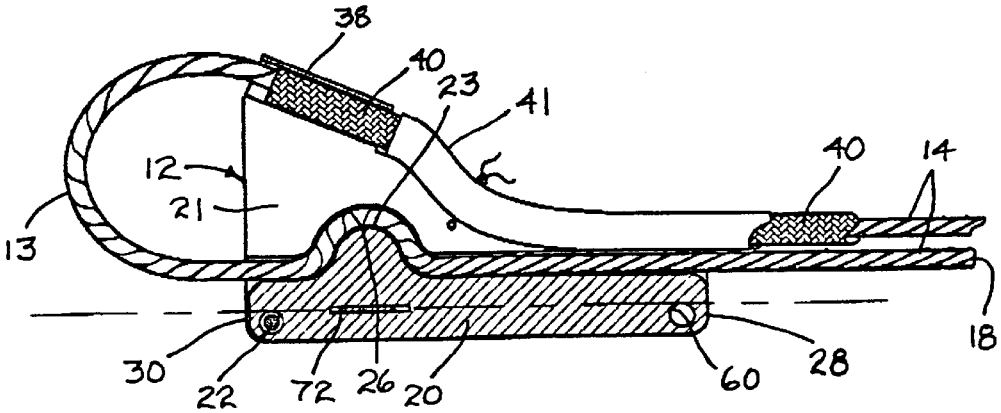
FIG. 4 shows a cross-sectional view of the first mechanism of FIGS. 1–3 as vie ed along cross-section lines 4—4 of FIG. 2.

The system 10 also includes a device for selectively fixing the first of the two lead-in portions of the first loop 13 in a stationary position within the first mechanism 12. In the present example, this device includes an elongated handle or bar 20 which is pivotally connected on one end portion, as at 22, to one end portion a pair of spaced apart side walls 24*a* and 24*b* (See FIG. 2) of a handle housing, designated 24 in FIG. 1, formed on a lower end portion of the body portion 21 of the first mechanism 12. The lower edge of the housing 24 is open to permit the bar 20 to be pivoted from an open position, as shown in FIG. 1, to a closed position within the housing as shown in FIGS. 2–4. The bar 20 is relatively flat, elongated, and generally rectangularly shaped except for a solid, arc shaped, flat sided bulge or projection 23 projecting from an edge which opposes a roof base 25 (See FIG. 1) of the housing 24 when the bar is in the closed position in the housing. The roof 25 of the housing 24 contains a hollow, arc shaped, flat sided depression or detent 26 (See FIG. 4) which communicates with the housing 24 and which conforms to the solid projection 23 on the bar 20 and is positioned such that the solid projection inserts into the depression as the bar 20 is closed in the housing 24. The first lead-in portion of the loop 13 slidably extends in and along the roof or base of the housing 24 from one end 28 to the other end 30 (See FIG. 1) thereof in a relatively straight line, as shown by dashed lines 14', when the bar 20 is open and thus spaced apart from the cable 14 as shown in FIG. 1. But when the handle 20 is moved toward the closed position as shown in FIG. 4, the solid projection 23 presses against the cable 14 and depresses a portion thereof into the detent 26, thus fixing the first lead-in portion of the first loop 13 in a stationary, non-slidable position in the housing 24 as shown.

The mechanism 12 of the present example is formed by two identical plates 32, 34 which are indented on upper and lower portions thereof so that, when the plates are fastened together as with a conventional plug or seam weld 36, rivets or otherwise, the mechanism is formed with the handle housing 24 on a lower end and a hollow cylinder 38 on an upper end (See particularly FIG. 2). A second lead-in portion of the first loop 13 slidably extends through the cylinder 38. The system 10 also includes an elongated, flexible, hollow sheath 40 of any suitable length, less than the length of the cable 14, through which the cable slidably extends. The sheath 40 may be in the form of conventional hydraulic hose having a braided cover over a plastic or Teflon tube which is widely available in this country at the present time. I prefer to use a 5/16 inch ID Teflon lined stainless steel hose such as manufactured by Dana Corporation, Boston Weatherhead Division, P.O. Box 1708, Brentwood, Tenn. 37024-1708 as Catalog No. H24305. The sheath 40 extends from a friction fit on one end portion thereof within the cylinder 38 to a friction fit within an enlarged diameter first end portion 42 of a hollow shaft formed through the second mechanism 16 (See FIG. 1). A small diameter second end portion 44 of the same hollow shaft should be large enough in diameter to permit the cable 14 to freely slide therethrough, but small enough to prevent the sheath 40 from entering therein. The sheath 40 thus fixes the distance between the first and second mechanisms 12 and 16 as measured along a central portion of the cable 14. The sheath 40 may also be covered by a flexible plastic tube 41 to prevent the sheath from scratching the hands of the user.

Referring now particularly to FIGS. 1 and 6, the end of the cable 14 which is connected to the second mechanism 16 is, preferably, frictionally secured in a metal fitting 46 which contains a ball shaped head 48. As in the case of the first mechanism 12, the second mechanism 16 is formed of two identical, indented plates 50*a* and 50*b* which are fastened together in any suitable manner such as by means of welding, as at 52, applied between flush portions 53 (See FIG. 1) of the plates, rivets or otherwise. Indented portions 54 of the plates 50*a* and 50*b* thus form the hollow shaft containing end portions 42 and 44 as previously mentioned. Similarly, an indented portion 56 forms an open side portion through which an end of the cable 14 extends and a bulbous portion 58 in which the ball head 48 on the end of the cable is trapped. The fitting 46 can thus rock in the portion 58 to allow a corresponding end portion of the cable 14 at the end of the second loop 17 to more readily flex to permit adjustments in the size of the second loop, particularly as the second loop becomes relatively small.

To lock the bar 20 in the closed position when desired, I prefer to use either of two arrangements, although any other suitable arrangement could be used. The first arrangement is to simply provide a pair of registered holes 59 through the side walls 24*a* and 24*b* of the handle housing 24 on a lower end portion opposite the end portion containing the pivot pin 22 as shown in FIG. 1. A similar size hole 60 is formed through a lower free end portion of the bar 20 which aligns and registers with the holes 59 when the bar is placed in the closed position in the housing 24 so that the shackle or bow of a conventional pad lock or combination lock can be inserted through the three holes 59, 60 to lock the bar in the closed position. A second arrangement, includes a cylinder lock housing 62 formed on one of the side walls 24*b* of the housing 24 which opens toward the bar 20 when closed as shown in FIG. 3. Within the housing 62 is placed a conventional rotatable cylinder lock 64 of the type which may be accessed and operated by inserting and rotating a key 66 therein, preferably from the underside of the housing 62 as viewed in FIGS. 1 and 3. A cam member 68 is rotatably attached on one end portion thereof to a rotatable key cylinder 70 of the lock 64 in the interior of the housing 62. An elongated slot 72 is formed in the body of the bar 20 which lies in the plane of the cam member 68 when the bar 20 is closed in the housing 24. By rotating the key 66 when inserted in the lock 64 and while the bar 20 is in the closed position, the cam member 68 is rotated into the slot 72 to lock the bar closed or can be rotated out of the slot to unlock the bar.

To use the system 10, the bar 20 is first placed in the unlocked position as in FIG. 1 to permit both lead-in portions of the first loop 13 to be slidable through the first mechanism 12 to permit adjusting the size of both loops 13 and 17. The second loop 17 is then attached to a first article, such as a boat cleat or piling and adjusted to a size conforming to the cleat or piling nearly as practical. The first loop 13 is then placed over and around a second article to be joined to the first article such as a dock piling or the like and the first loop is adjusted to a size conforming as nearly as practical to the second article by pulling the free end 18 of the cable 14 away from the first mechanism 12. When the first and second loops 13 and 17 have been placed over the respective articles and properly sized, the locking bar 20 is closed into the housing 24 to depress the cable 14 into the detent 26 with the projection 22 and the bar 20 is locked in place as previously explained. Because the free end 18 of the cable 14 can be readily removed completely from the first mechanism 12, that end of the cable can also be used by being inserted through an article such as an eye bolt.

Although the present invention has been shown and described with respect to specific details of a certain preferred embodiment thereof, it is not intended that such details limit the scope and coverage of this patent other than as specifically set forth in the following claims.

I claim:

1. A system for securing a pair of spacially separated articles together comprising an elongated, flexible cable;

a first mechanism slidably containing two lead-in portions of a first loop formed on a first end portion of said cable for adjusting the size of said first loop;

a second mechanism slidably containing a first of two lead-in portions of a second loop formed on a second end portion of said cable for permitting adjustment in the size of said second loop, an end of said cable at an end of said second loop being fixedly secured to said second mechanism;

a device for selectively fixing a first of said two lead-in portions of said first loop in a stationary position within said first mechanism when in an operative condition, said first of said two lead-in portions of said first loop containing a free end of said cable, a second of said two lead-in portions of said first loop being connected to said first of said two lead-in portions of said second loop to form a central portion of said cable extending between said first and second mechanisms; and an elongated, flexible, hollow sheath slidably covering said central portion of said cable, said sheath being affixed on opposite end portions thereof to said first and second mechanisms such that said first and second mechanisms are spaced apart by a fixed distance as measured along said central portion of said cable.

2. The system of claim 1 wherein said device comprises an elongated handle pivotally attached on one end portion thereof to said first mechanism, said handle having a closed, operative position in said first mechanism wherein said handle presses said first of said two lead-in portions of said first loop against said first mechanism and an open position spaced from said cable.

3. The system of claim 1 further comprising an assembly for selectively locking said device in said operative condition.

4. The system of claim 1 further comprising means for selectively locking said device in said operative condition.

5. The system of claim 1 wherein said first mechanism comprises a relatively flat central body portion;

a hollow, elongated handle housing attached to a lower side of said central body portion, said housing defining a generally rectangular shaped cavity which opens along an elongated base thereof and including a hollow, flat sided, arc shaped depression projecting above and communicating with said rectangularly shaped cavity; and an elongated, hollow, open ended cylinder through which said second of said two lead-in portions of said first loop, slidably extends, said cylinder being attached to an upper side of said central portion of said body, one end of said sheath being frictionally and fixedly attached within said cylinder.

6. The system of claim 1, wherein said first mechanism comprises two identically shaped plates which are fastened together on flush portions thereof.

7. The system of claim 1 wherein said second mechanism comprises two identically shaped plates which are fastened together on flush portions thereof.

8. The system of claim 5 wherein said body portion, handle housing and cylinder are formed by two identically shaped plates which are fastened together on said body portion.

9. The system of claim 5 wherein said device comprises a handle forming an elongated, rectangularly shaped, flat bar which is pivotally attached on one end portion thereof to one end portion of said handle housing, such that said bar pivots into said handle housing when moved to said operative position and pivots out of said housing when moved to an inoperative position, said bar containing a solid, arc shaped projection on and along one elongated edge thereof which conforms to and fits in said hollow, arc shaped depression when said bar is placed in said operative position so as to press against and deform a part of said first lead-in portion of said first loop into said hollow depression, said first lead-in portion of said first loop slidably extending through said first mechanism longitudinally along a roof of said handle housing in a relatively straight line when said handle is disposed in said inoperative position.

10. The system of claim 9 further comprising an assembly for selectively locking said bar in said operative position in said housing, said assembly comprising an elongated slot formed in said bar;

a lock housing mounted on a side of said handle housing, said lock housing opening through a side wall of said handle housing toward a flat side of said bar when said bar is disposed in said operative position in said handle housing;

a rotary lock mounted in said lock housing, an axis of rotation of a rotary cylinder of said lock extending parallel to and transversely across said bar; and a rotary cam mounted for rotational movement on said rotary cylinder, said cam being rotatable to a locked position extending into said slot with rotation of said locking cylinder to lock said bar in said operative position and rotatable to an unlocked position with reverse rotation of said locking cylinder wherein said cam is removed from said slot.

11. The system of claim 9 further comprising means for selectively locking said device in said operative position, said means comprising a first aperture formed in a free end portion of said bar; and a pair of registered apertures formed through the side walls of said housing on an end portion thereof which is opposite the end portion on which said bar is pivotally attached to said housing, said pair of apertures registering with said first aperture when said bar is disposed in said operative position in said housing such that a pad lock shackle can be inserted through said registered apertures in said housing side walls and said bar to lock said bar in said operative position in said housing.

12. The system of claim 1 wherein said second mechanism comprises a pair of plates fastened together on flush portions thereof and containing indentions which form an open end portion for insertion of an end of said cable on an end of said second loop therein, said cable end containing a fitting having a ball shaped head which is disposed for rocking movement and is trapped within a bulbous portion of said second mechanism, which bulbous portion communicates with said open end portion.

* * * * *